US008548870B1

(12) United States Patent
Herbette et al.

(10) Patent No.: US 8,548,870 B1
(45) Date of Patent: Oct. 1, 2013

(54) TRANSACTION-DRIVEN SOCIAL NETWORK

(71) Applicant: VPSN, Inc., Hartford, CT (US)

(72) Inventors: Leo Herbette, West Simsbury, CT (US); Richie Bavasso, Pawcatuck, CT (US)

(73) Assignee: Rimedio, Inc., Hartford, CT (US)

( * ) Notice: Subject to any disclaimer, the term of this patent is extended or adjusted under 35 U.S.C. 154(b) by 0 days.

(21) Appl. No.: 13/705,308

(22) Filed: Dec. 5, 2012

Related U.S. Application Data

(63) Continuation of application No. 13/653,253, filed on Oct. 16, 2012.

(51) Int. Cl.
*G06Q 30/00* (2012.01)

(52) U.S. Cl.
USPC ..... 705/26.35; 705/2; 705/26.1; 705/26.3; 705/27.1; 705/319

(58) Field of Classification Search
USPC ..... 705/26.1, 27.1, 26.3, 26.35, 319, 705/2
See application file for complete search history.

(56) References Cited

U.S. PATENT DOCUMENTS

| | | | | |
|---|---|---|---|---|
| 6,980,982 | B1 * | 12/2005 | Geddes et al. | 705/27.1 |
| 7,529,689 | B2 * | 5/2009 | Rowan | 705/26.1 |
| 7,792,699 | B2 * | 9/2010 | Kwei | 705/26.4 |
| 2011/0125569 | A1 * | 5/2011 | Yoshimura et al. | 705/14.36 |

FOREIGN PATENT DOCUMENTS

WO WO 2005091190 A2 * 9/2005

OTHER PUBLICATIONS

"Networking Opportunities: Social Networking for Business," by Nancy Davis Kho, EContent, May 2007; 30, 4, pp. 24-29.*
Sittercity.com, located at http://web.archive.org/web/20110714041356/http://www.sittercity.com/about.html, dated Jul. 14, 2011, accessed on Jul. 23, 2013.*
Care.com, located at http://web.archive.org/web/20110604041014/http://www.care.com/, dated Jun. 4, 2011, accessed on Jul. 23, 2013.*

* cited by examiner

*Primary Examiner* — Jeffrey A Smith
*Assistant Examiner* — Anne Georgalas
(74) *Attorney, Agent, or Firm* — Cantor Colburn LLP

(57) ABSTRACT

A transaction-based social network for a life science vertical industry is provided. A method for implementing the network includes qualifying a user to join the transaction-based social network based on a minimum set of qualifications. The method also includes creating, from input received by the user, an opportunity with respect to an offer, identifying members of a target user community in the network based on the input from the user, and posting the opportunity over the social network to the members of the target user community. The method further includes receiving at least one response from the target user community that is indicative of a bid to accept the opportunity. The method also includes providing a view of the bid for the user and, once accepted, executing a transaction based on a pre-negotiated fee. The executing includes validating regulatory compliance of content associated with the transaction.

30 Claims, 14 Drawing Sheets

300

400

Opportunity Manager

401

- Open Opportunities
- My Bid Opportunities
- My Posted Opportunities
- Post New Opportunity
- Compensation Manager

402

406 404

| ID | Target User | Type | Description | Posted (Date) | Expires (Date) | Replies (QTY) | Community | Owner |
|---|---|---|---|---|---|---|---|---|
| 321 | Sales Rep, Pharma | Sample Drop | Requesting samples of Supemra. | 09/23/12 | 09/30/12 | 78 | Global | Carly.Carlson |
| 545 | Sales Rep | Medical Inquiry | What are the counteractions of prescribing Supemra to a patient taking Flexergesic? | 09/29/12 | 09/30/12 | 2 | US, RA | Jack.Sparrow |
| 9,564 | Sales Rep | HCP Meeting Request | Request in person lunch and learn about new treatments available for patients with RA. | 09/24/12 | 10/14/12 | 6 | California, RA | Shawn.Christian |
| 453 | Sales Rep | HCP Meeting Request | Lorem ipsum dolor sit amet, consectetur adipiscing elit. Morbi eu elit sit amet massa posuere cursus. | 09/25/12 | 10/25/12 | 2 | California | Jennifer.Lee |
| 56 | Sales Rep | HCP Medical Inquiry | Morbi nunc dolor, malesuada in tempus vel, posuere id nunc. | 09/25/12 | 11/1/12 | 1* | RA | James.Scott |
| 6,546 | Sales Rep | Medical Inquiry | Nam et quam non sem dapibus dapibus nec ut dolor. | 09/27/12 | 11/3/12 | 5* | RA | Tanja.Pundre |
| 32 | Sales Rep | Sample Drop | Pellentesque quam nunc, accumsan ut lacinia vitae. | 09/29/12 | 11/3/12 | 0 | Global | Cathy.Phillips |
| 900,000 | Sales Rep | Sample Drop | Donec ut sem in sem ultrices commodo. | 09/23/12 | 11/12/12 | 35 | US | Stephanie. Decker |
| 321 | Sales Rep | HCP Meeting Request | Maecenas sodales, orci vel pulvinar tincidunt, turpis lectus tempor mauris, ut eleifend | 10/10/12 | 11/12/12 | 8 | US, RA | Casey.ODonnell |

FIG. 4

500

Opportunity Manager

501

- Open Opportunities
- My Bid Opportunities
- My Posted Opportunities
- Post New Opportunity
- Compensation Manager

| ID | Target User | Type | Description | Posted (Date) | Expires (Date) | Replies (QTY) | Community | Owner |
|---|---|---|---|---|---|---|---|---|
| 321 | Sales Rep, Pharma | Sample Drop | Requesting samples of Supemra. | 09/23/12 | 09/30/12 | 78 | Global | Carly.Carlson |
| 545 | Sales Rep | Medical Inquiry | What are the counteractions of prescribing Supemra to a patient taking Flexergesic? | 09/29/12 | 09/30/12 | 2 | US, RA | Jack.Sparrow |
| 9,564 | Sales Rep | HCP Meeting Request | Request in person lunch and learn about new treatments available for patients with RA. | 09/24/12 | 10/14/12 | 6 | California, RA | Shawn.Christian |

502

Details

Asking for a rep to visit Dr. Daniel Jonas in Los Angelos California. He would like more information about treatments

Restrictions

- Rep must be certified for detailing Supemra.
- Must be available to meet in person.

Rate

Fixed at $500

Comments

I am requesting a higher rate to cover the cost of Dr. Jonas' meal.

Propose New Rate

$550.00

504 Make Bid | Request Collaboration 506

| | | | | | | | | |
|---|---|---|---|---|---|---|---|---|
| 453 | Sales Rep | HCP Meeting Request | Lorem ipsum dolor sit amet, consectetur adipiscing elit. Morbi eu elit sit amet massa posuere cursus. | 09/25/12 | 10/25/12 | 2 | California | Jennifer.Lee |
| 56 | Sales Rep | HCP Medical | Morbi nunc dolor, malesuada in tempus | 09/25/12 | 11/1/12 | 1* | RA | James.Scott |

FIG. 5

600

Opportunity Manager

- Open Opportunities
- My Bid Opportunities
- My Posted Opportunities
- Post New Opportunity
- Compensation Manager

602

| ID | Target User | Type | Description | Status | Expires (Date) | Replies (QTY) | Community | Owner |
|---|---|---|---|---|---|---|---|---|
| 9,564 | Sales Rep | HCP Meeting Request | Request in person lunch and learn about new treatments available for patients with RA. | Open | 09/30/12 | 7 | California, RA | Shawn.Christian |

608

| User | User Ranking | Collaboration Bid? | Bidder Rate | Bidder Comments | |
|---|---|---|---|---|---|
| Brian.Walker | 98% | Yes | $550 | I am requesting a higher rate to cover the cost of Dr. Jonas' meal. | Accept Bid |
| Emily.Johnson | 98% | Yes | $575 | Proin in purus risus. Fusce accumsan vehicula mi a pulvinar. | Accept Bid |
| James.Moore | 96% | No | $500 | Mauris urna nisi, fermentum pretium semper eget, lacinia id. | Accept Bid |
| David.Black | 95% | No | $550 | Donec risus felis, cursus a gravida sit amet, ultrices a felis. | Accept Bid |
| Maria.Hall | 89% | Yes | $500 | Vestibulum eget neque gravida ante mollis dapibus eget non elit. | Accept Bid |
| Gary.Bennett | 89% | No | $500 | Proin dapibus risus quis lorem consectetur mattis. | Accept Bid |
| Lisa.Foster | 87% | Yes | $500 | ISed non ligula turpis, at sodales | Accept Bid |

604

606

| | | | | | | | | |
|---|---|---|---|---|---|---|---|---|
| 9,563 | MSL | Medical Inquiry | What are the contradindications of prescribing Supemra with TNF inhibitors? | Open | 09/30/12 | 78 | Global | Shawn.Christian |
| 7,152 | MSL | Medical Inquiry | What are the adverse events associated with Supemra to a diabetic patient? | Open | 10/14/12 | 2 | US, RA | Shawn.Christian |
| 5,565 | Sales Rep | Sample | Lorem ipsum dolor | Closed | 11/1/12 | 3 | RA, CD | Shawn.Christian |

FIG. 6

800

Compensation Manager

- Open Opportunities
- My Bid Opportunities
- My Posted Opportunities
- Post New Opportunity
- Compensation Manager

Compensation Summary

| | | | |
|---|---|---|---|
| Payments Received: | $33,428.13 | Date of Last Transaction: | 10/10/2012 |
| Payments Pending: | $12,501.00 | Last Transaction Amount: | $550.00 |
| Total Expected Receivables: | $45,929.13 | Last Paid Transaction: | $625.00 |

Compensation Details

804

802

806

| Opp ID | Transaction ID | Payor | Transaction Type | Description | Transaction Status | Payment Status | Amount |
|---|---|---|---|---|---|---|---|
| 9,564 | 15,524 | Shawn.Christian | HCP Meeting Request | Request in person lunch and learn about new treatments available for patients with RA. | Completed | Pending | $550.00 |
| 9,564 | 15,524x1 | Shawn.Christian | # MoD | This MoD was initiated while fullfilling Oppurtunity #9,564. | Completed | Pending | $100.00 |
| 56 | 120 | James.Scott | Medical Inquiry | Morbi nunc dolor, malesuada in tempus vel, posuere id nunc. | Accepted | Paid | $625.00 |
| 6,546 | 7,695 | Tanja.Pundre | Medical Inquiry | Nam et quam non sem dapibus dapibus nec ut dolor. | Accepted | Pending | $625.00 |
| 321 | 451 | Casey.ODonnell | HCP Meeting Request | Maecenas sodales, orci vel pulvinar tincidunt | Pending | Pending | $750.00 |

Go To Opportunity

Transaction Details
Transaction Completed: 10/09/12
Transaction Accepted: N/A
Transaction Opened: 10/09/12

Payment Details
Date Paid: TBD
Payment Type: TBD

Comments
Lorem ipsum empus id iaculis magna tincidunt.

FIG. 8

1000

Compensation Manager

- Open Opportunities
- My Bid Opportunities
- My Posted Opportunities
- Post New Opportunity
- Compensation Manager

1002

Compensation Summary

| | | | |
|---|---|---|---|
| Payments Received: | $33,428.13 | Date of Last Transaction: | 10/10/2012 |
| Payments Pending: | $12,501.00 | Last Transaction Amount: | $550.00 |
| Total Expected Receivables: | $45,929.13 | Last Paid Transaction: | $625.00 |

Compensation Details 1004 1006 1008

| Opp. ID | Transaction ID | Payor | Transaction Type | Description | Transaction Status | Payment Status | Amount |
|---|---|---|---|---|---|---|---|
| 9,564 | 15,524 | Shawn.Christian | HCP Meeting Request | Request in person lunch and learn about new treatments available for patients with RA. | Completed | Pending | $550.00 |
| 9,564 | 15,524x1 | Shawn.Christian | # MoD | This MoD was initiated while fullfilling Oppurtunity #9,564. | Completed | Pending | $100.00 |
| 56 | 120 | James.Scott | Medical Inquiry | Morbi nunc dolor, malesuada in tempus vel, posuere id nunc. | Accepted | Paid | $625.00 |
| 6,546 | 7,695 | Tanja.Pundre | Medical Inquiry | Nam et quam non sem dapibus dapibus nec ut dolor. | Accepted | Pending | $625.00 |
| 321 | 451 | Casey.ODonnell | HCP Meeting Request | Maecenas sodales, orci vel pulvinar tincidunt, turpis lectus tempor mauris, ut eleifend augue lacus ac diam. | Pending | Pending | $750.00 |
| 462,131 | 786,258 | Georg.Schulz | Sample Drop | Curabitur a est at felis dictum dignissim non id velit | Completed | Paid | $100.00 |

FIG. 10

1100

Compensation Manager

- Open Opportunities
- My Bid Opportunities
- My Posted Opportunities
- Post New Opportunity
- Compensation Manager

Compensation Summary

| | | | |
|---|---|---|---|
| Payments Received: | $33,428.13 | Date of Last Transaction: | 10/10/2012 |
| Payments Pending: | $12,501.00 | Last Transaction Amount: | $550.00 |
| Total Expected Receivables: | $45,929.13 | Last Paid Transaction: | $625.00 |

Compensation Details

| Opp ID | Transaction ID | Payor | Transaction Type | Description | Transaction Status | Payment Status | Amount |
|---|---|---|---|---|---|---|---|
| 9,564 | 15,524 | Shawn.Christian | HCP Meeting Request | Request in person lunch and learn about new treatments available for patients with RA. | Completed | Pending | $550.00 |
| 9,564 | 15,524x1 | Shawn.Christian | # MoD | This MoD was initiated while fullfilling Oppurtunity #9,564. | Completed | Pending | $100.00 |
| 56 | 120 | James.Scott | Medical Inquiry | Morbi nunc dolor, malesuada in tempus vel, posuere id nunc. | Accepted | Paid | $625.00 |
| 6,546 | 7,695 | Tanja.Pundre | Medical Inquiry | Nam et quam non sem dapibus dapibus nec ut dolor. | Accepted | Pending | $625.00 |
| 321 | 451 | Casey.ODonnell | HCP Meeting Request | Maecenas sodales, orci vel pulvinar tincidunt | Pending | Pending | $750.00 |

1102 Go To Opportunity

Transaction Details
Transaction Completed: 10/09/12
Transaction Accepted: 9/27/12
Transaction Opened: 9/24/12

Payment Details
Date Paid: TBD
Payment Type: TBD

Comments
Lorem ipsum empus id iaculis magna tincidunt.

FIG. 11

1200

Compensation Manager

- Open Opportunities
- My Bid Opportunities
- My Posted Opportunities
- Post New Opportunity
- Compensation Manager

Compensation Summary

| | | | |
|---|---|---|---|
| Payments Paid: | $265,131.00 | Date of Last Transaction: | 10/09/2012 |
| Payments Pending: | $125,135.00 | Last Transaction Amount: | $550.00 |
| Total Expected Payables: | $390,266.00 | Last Transaction Paid: | $750.00 |

Compensation Details

| Opp ID | Transaction ID | Payee | Transaction Type | Description | Transaction Status | Payment Status | Amount |
|---|---|---|---|---|---|---|---|
| 9,564 | 15,524 | Brian.Walker | HCP Meeting Request | Request in person lunch and learn about new treatments available for patients with RA. | Completed | Pending | $550.00 |
| 9,564 | 15,524x1 | Brian.Walker | # MoD | What are the contradindications of prescribing Supemra with TNF inhibitors? | Completed | Pending | $100.00 |
| 7,152 | 7,695 | Anja.Muller | Medical Inquiry | What are the adverse events associated with Supemra to a diabetic patient? | Pending | Pending | $625.00 |
| 5,565 | 7.263 | Jay.Masters | Sample Drop | Lorem ipsum dolor sit amet, consectetur adipiscing elit. Integer urna felis, luctus sit amet condimentum ac, placerat eget felis. | Completed | Paid | $750.00 |
| 4,566 | 6,964 | Silvia.Stone | Medical Inquiry | Aliquam varius diam vitae lorem tempus id iaculis magna tincidunt. | Completed | Paid | $500.00 |

FIG. 12

TRANSACTION-DRIVEN SOCIAL NETWORK

CROSS-REFERENCE TO RELATED APPLICATIONS

This application is a continuation of U.S. patent application Ser. No. 13/653,253, filed Oct. 16, 2012, the entire contents of which are incorporated herein by reference.

BACKGROUND

The present invention relates to transaction-based social networking, and more specifically, to a private, business-rule compliant and secure business-to-business social network enabling transactions between stakeholders.

Currently, the life science vertical and related industries utilize a business model that is push-driven. Pharmaceutical sales representatives undergo training and certification regarding one or more drugs sold by the pharmaceutical companies. Once certified, these sales representatives are tasked with calling medical facilities in an effort to schedule in-person visits with health care providers to inform the providers about these drugs.

This business model can be very inefficient in that oftentimes busy health care providers have little time to engage with the sales representatives. Some health care providers are resistant to such meetings altogether, such that scheduling time to meet with them is rendered more difficult. Furthermore, this business model is extremely expensive to maintain for the pharmaceutical companies, as each visit costs the pharmaceutical companies hundreds, if not thousands, of dollars.

What is needed, therefore, is a way to more efficiently engage members of the life science vertical industry.

SUMMARY

According to one embodiment of the present invention, a method is provided. The method includes qualifying a user to join a transaction-based social network for a life science vertical industry based on a minimum set of qualifications. The method also includes creating, from input received by the user, an opportunity with respect to an offer, identifying members of a target user community in the network based on the input from the user, and posting the opportunity over the social network to the members of the target user community. The method further includes receiving at least one response from the target user community that is indicative of a bid to accept the opportunity. The method also includes providing a view of the bid for the user and, once accepted, executing a transaction based on a pre-negotiated fee. The executing includes validating regulatory compliance of content associated with the transaction.

According to another embodiment of the present invention, a system is provided. The system includes a computer processor and an application executable by the computer processor. The application is configured to implement a method. The method includes qualifying a user to join a transaction-based social network for a life science vertical industry based on a minimum set of qualifications. The method also includes creating, from input received by the user, an opportunity with respect to an offer, identifying members of a target user community in the network based on the input from the user, and posting the opportunity over the social network to the members of the target user community. The method further includes receiving at least one response from the target user community that is indicative of a bid to accept the opportunity. The method also includes providing a view of the bid for the user and, once accepted, executing a transaction based on a pre-negotiated fee. The executing includes validating regulatory compliance of content associated with the transaction.

According to further embodiment of the present invention, a computer program product is provided. The computer program product including a storage medium encoded with computer-readable program code, which when executed by a computer, cause the computer to implement a method. The method includes qualifying a user to join a transaction-based social network for a life science vertical industry based on a minimum set of qualifications. The method also includes creating, from input received by the user, an opportunity with respect to an offer, identifying members of a target user community in the network based on the input from the user, and posting the opportunity over the social network to the members of the target user community. The method further includes receiving at least one response from the target user community that is indicative of a bid to accept the opportunity. The method also includes providing a view of the bid for the user and, once accepted, executing a transaction based on a pre-negotiated fee. The executing includes validating regulatory compliance of content associated with the transaction.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

FIGS. 3-14 depict user interface screens provided by the transaction-based social network according to embodiments of the present invention.

DETAILED DESCRIPTION

Exemplary embodiments provide a transaction-based social network and related functions for qualified members of the life science vertical and related industries. In contrast to traditional networking sites which allow users to post information in a passive manner and render the information available to certain contacts for passive viewing, the transaction-based social network provides a business rule-driven content management system along with remote exchange utilities to allow stakeholders to convey information in the form of standard content formats such as Powerpoint, PDF, movies, interactive HTML along with Voice Over IP (VoIP) in a compliant manner.

The transaction-based social network operates a new business model in which any member can create an opportunity that is directed to one or more members of the network. In an embodiment, the opportunity includes criteria defined by the member, which criteria are then used to identify a target audience within the membership, and the opportunity is posted over the network for review and consideration by the target audience. If a transaction to which the opportunity relates is completed between the poster of the opportunity and a member of the target audience, a pre-negotiated fee is exchanged via the network between the poster and the member. In another embodiment, an opportunity may be created and posted by an intelligent agent of the transaction-based social network, e.g., based on activities conducted by one or more members of the network. In a further embodiment, a transaction conducted for a given opportunity may spawn a new transaction, which is processed through the network. This type of transaction is referred to herein as an "implicit" transaction, as it is generated from the same opportunity as the original transaction. It will be understood that multiple new transactions may be spawned from a single opportunity. As used herein, an opportunity refers to an offer to provide information, items, or service or a request to receive information, items, or a service. These, and other, features of the transaction-based social network will now be described. It is understood in advance that although this disclosure includes a description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service.

Figure 1:
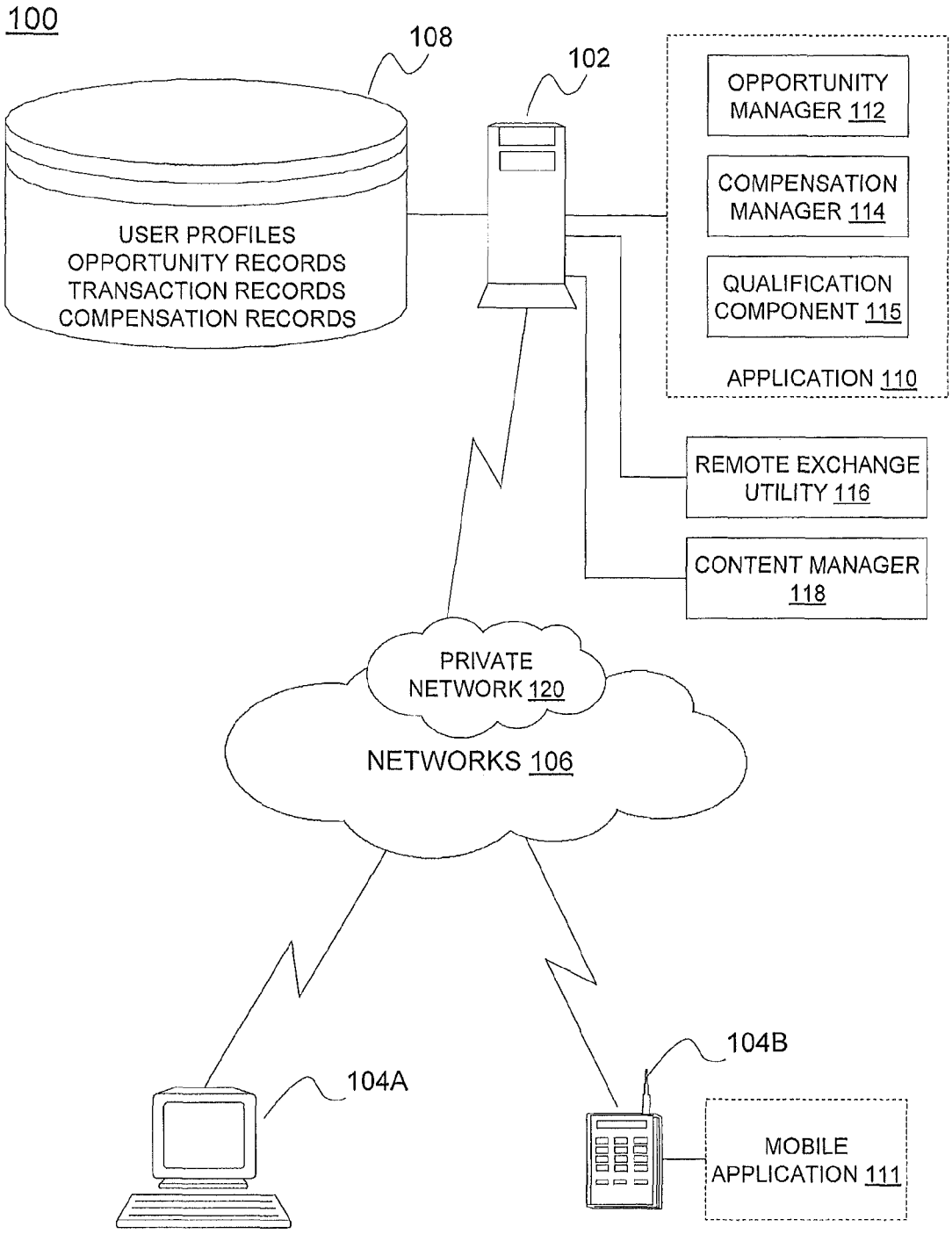
FIG. 1 depicts a system upon which the transaction-based social network processes may be implemented in accordance with an embodiment of the present invention.

Turning now to FIG. 1, a system 100 upon which the transaction-based social network may be implemented will now be described in an exemplary embodiment. The system 100 may be implemented via a cloud computing architecture. Alternatively, the system 100 may be implemented, e.g., using a client/server architecture.

The system 100 includes a host system computer 102 and user systems 104A-104B communicatively coupled to networks 106. The host system computer 102 may be implemented as a high-speed computer processing device for handling the volume of activities associated with users of the transaction-based social network. In an embodiment, the host system computer 102 is operated by a service provider enterprise.

The user systems 104A-104B may be operated by end users of the transaction-based social network described herein. The user system 104A may be implemented as a general-purpose computer (e.g., desktop or laptop), and the user system 104B may be implemented as a mobile device, such as a smart phone, tablet, or personal digital assistant. While only two user systems 104A-104B are shown in FIG. 1 for ease of illustration, it will be understood that any number of user systems may be employed in order to realize the advantages of the exemplary embodiments.

The system 100 of FIG. 1 also includes a storage device 108 communicatively coupled to the host system computer 102. The storage device 108 may be implemented using a variety of devices for storing electronic information. It is understood that the storage device 108 may be implemented using memory contained in the host system computer 102 or it may be a separate physical device, as illustrated in FIG. 1. The storage device 108 may be logically addressable as a consolidated data source across a distributed environment that includes the networks 106. Information stored in the storage device 108 may be retrieved and manipulated via the host system computer 102 and authorized users of user systems 104A-104B. The storage device 108 houses user profiles, opportunity records, transaction records, and compensation records, among other information desired by the enterprise implementing the host system computer 102. In an embodiment, the host system computer 102 operates as a database server and coordinates access to application data including data stored on storage device 108.

The networks 106 may be any type of known networks including, but not limited to, a wide area network (WAN), a local area network (LAN), a global network (e.g. Internet), and an intranet. As shown in FIG. 1, the networks 106 include a private network 120 in which access thereto is restricted to authorized members. Access by authorized user systems 104A-104B through the private network 120 to the host system computer 102, storage device 108, and to one another forms the transaction-based social network described herein. The networks 106 may be implemented using wireless networking technologies or any kind of physical network implementation known in the art. User systems 104A-104B may be coupled to the host system computer 102 through multiple networks (e.g., Internet, intranet, and private network 120) so that not all user systems are coupled to the host system computer 102 through the same networks.

The host system computer 102 executes an application 110 for implementing the transaction-based social network functions described herein. The application 110 may be configured to include various modules that perform selected functions. As shown, e.g., in FIG. 1, an opportunity manager 112 and a compensation manager 114 are provided. The opportunity manager 112 and the compensation manager 114 may be configured as modules or components of the application 110. The application 110 also includes a qualification component 115 for qualifying users for access to the transaction-based social network. As indicated above, the transaction-based social network provides a networking platform for various individuals and entities associated with the medical industry. Non-limiting examples of users include health care providers, pharmaceutical companies, pharmaceutical sales representatives employed by the pharmaceutical companies, freelance pharmaceutical sales representatives, service agents, insurers, payers, medical supply companies and representatives, and medical equipment companies and representatives.

The system 100 of FIG. 1 also includes a remote exchange utility 116 and a content manager 118. The remote exchange utility 116 and the content manager 118 may be implemented by the host system computer 102, e.g., as middleware. The remote exchange utility 116 and the content manager 118 are configured to monitor the network and ensure data and content exchanged among members of the network conform to various regulatory requirements. Thus, for example, members are precluded from editing, adding, or deleting content from content sources that have been certified compliant via the content manager 118, and are also precluded from sharing such information with other members via the remote exchange utility 116.

Figure 2:
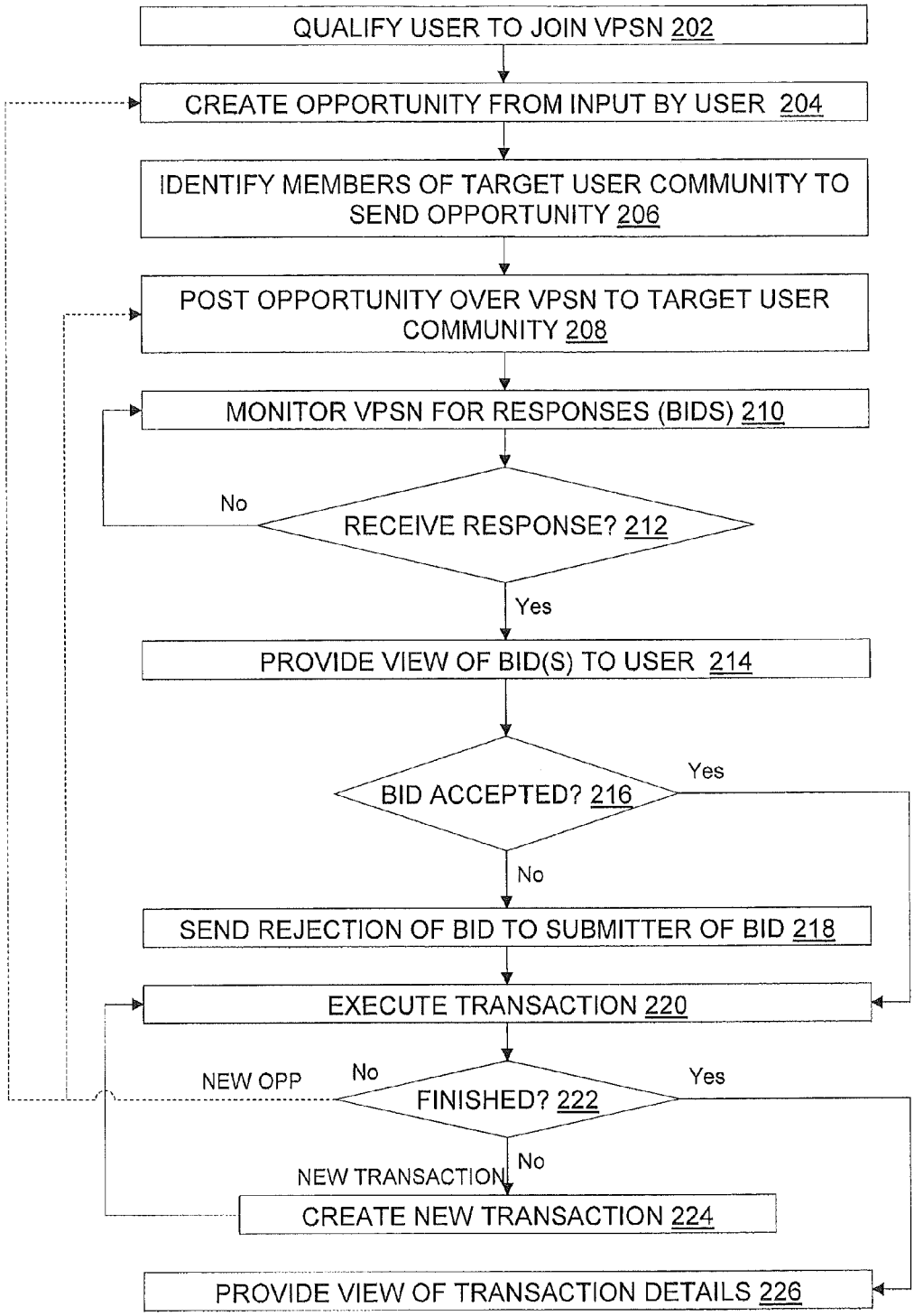
FIG. 2 depicts a flow diagram of a process for implementing a portion of the transaction-based social network according to an embodiment of the present invention.

Turning now to FIG. 2, a flow diagram describing a process for implementing a portion of the transaction-based social network services will now be described in an embodiment. The process described in FIG. 2 assumes that a user (e.g., a user of one of user systems 104A-104B) is requesting membership to the transaction-based social network. For purposes of illustration, the process of FIG. 2 also assumes that the user is a pharmaceutical representative of a pharmaceutical company.

At step 202, the qualification component 115 of the application 110 qualifies the user to join the transaction-based social network based on a minimum set of qualifications. The set of qualifications may include a validation of the user using a medical licensing status and/or a certification status of the user. For example, a health care provider may be qualified by providing an identification number associated with his/her medical license, while a pharmaceutical sales representative may be qualified by providing a unique identification associated with a certification relating to a type of training. Alternatively, or in addition thereto, the qualifications considered by the qualification component 115 may include a tax identification number. The qualification component 115 may be configured to access one or more external sources of information to validate the qualification information provided by a user who is requesting membership.

Once qualified, the application 110 creates a profile for the user. The profile includes identifying information, such as the user's name, address, and contact information. The user is also prompted to provide additional information that identifies the user as a particular user type. For example, user types may include doctors, health care providers, pharmaceutical company representatives, pharmaceutical sales representatives, freelance pharmaceutical sales representatives, medical supply and equipment sales representatives, insurers, service agents, content agencies, key opinion leaders, medical science liaisons, and the like. The application 110 may further identify the user as belonging to at least one user community. User communities refer to one or more of a geographic region (country, state, city) in which the user lives or works, a specialty of the user (e.g., types of drugs in which the user is certified to sell, or a specialty practice of a health care provider) or tier. This information is stored in the profile for the user and the profile is stored in the storage device 108.

Figure 3:
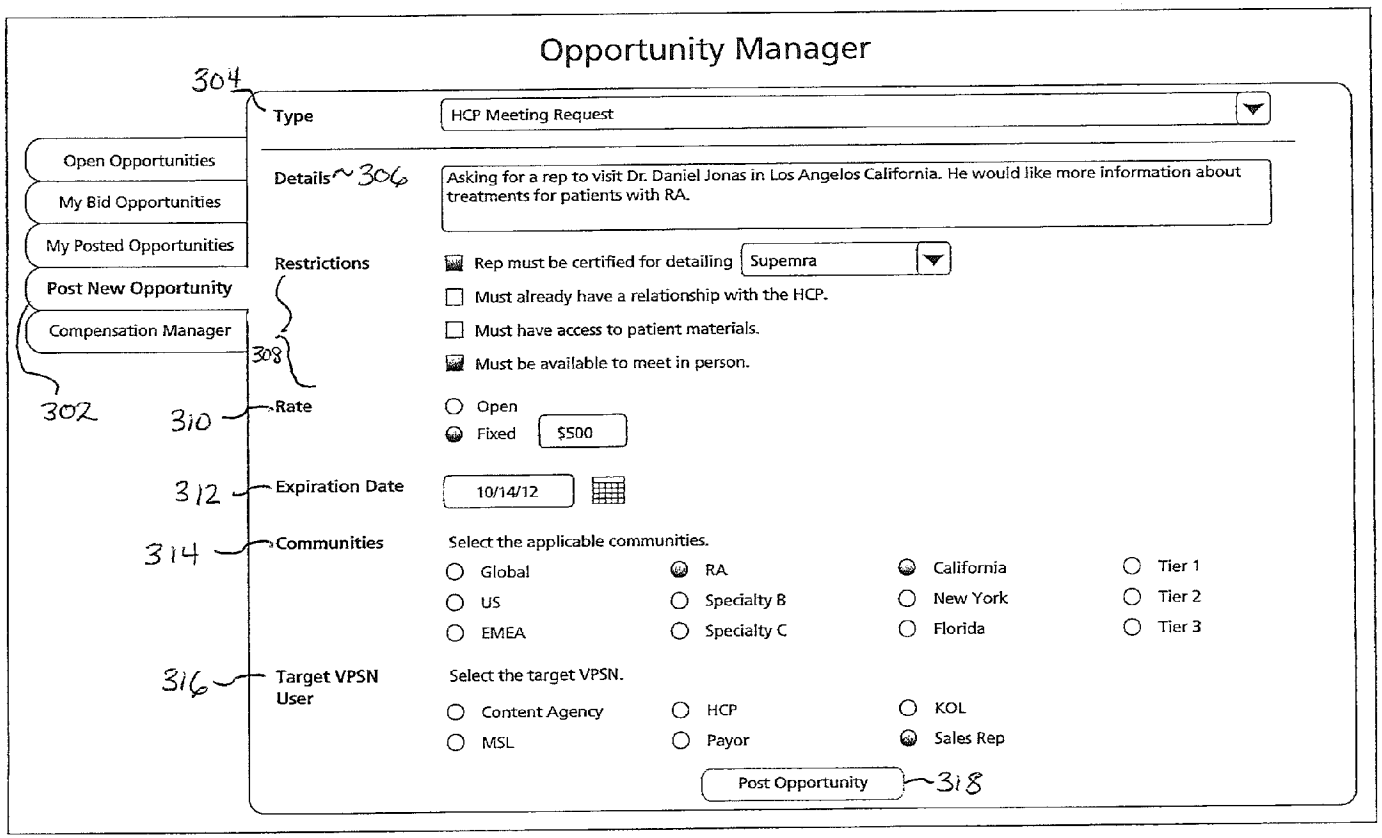

Once the profile is completed, the user may access a variety of features of the transaction-based social network. For example, in one embodiment, the user may view opportunities posted by other members or create a new opportunity with respect to the 'life science vertical and related industries' offer by providing input concerning the opportunity via the opportunity manager 112 of the application 110. At step 204, the application 110 creates the opportunity from the input provided by the user. As shown in FIG. 3, a user interface screen 300 is presented to the user when the user selects a tab "Post New Opportunity" 302.

The input includes an opportunity type 304, which is selectable by the user, e.g., from a drop down list of opportunity types. Any number of opportunity types may be configured via the application 110. Examples of opportunity types include health care provider (HCP) meeting request (in-person or remote exchange), medical inquiry, and sample drop (e.g., request for drug samples, brochures, literature, etc.), remote exchange meeting or conference, conference speaker, and workshop facilitator, to name a few. In an embodiment, the opportunity types may be configured by an administrator or representative of the host system computer 102. The information and fields provided in the user interface screen 300 may dynamically activate depending on the opportunity type selected by the user. It will be understood that other information and fields may be presented, and the information and fields shown in FIG. 3 are provided for illustrative purposes and are not intended to limit the scope of the embodiments described herein. The user interface screen 300 also includes a box 306 in which the user may enter additional details about the opportunity. The user may select from a list of restrictions or constraints 308, as shown in FIG. 3. These constraints represent the qualifications and criteria that must be satisfied by a responder of the opportunity.

The user interface screen 300 also includes an option 310 in which the user may enter a rate associated with the opportunity. If the opportunity is a request for information, items, or services, the rate reflects an amount of money the user is willing to pay a successful bidder to implement the opportunity. If the opportunity is an offer to provide information, items, or services, the rate reflects an amount of money the user is charging a successful bidder. As shown in FIG. 3, the rate may be fixed or may be open. The user may also enter an expiration date in a field 312, which date indicates when the opportunity expires. Once expired, the application 110 removes the opportunity posting from the network.

Also as shown in FIG. 3, the user may select a user community for which the opportunity is targeted. Non-limiting examples of user communities 314 are provided in the user interface screen 300 and include, e.g., geographic locations, medical specialties (e.g., an area of medicine practiced by a physician), and tiers. Similarly, the user may select a target user 316 for which the opportunity will be sent. Target users may include content agencies, medical science liaison (MSL), HCP, payor, key opinion leaders (KOL), and sales representatives. When the user has finished entering this information, the user selects an option 318 "Post Opportunity." The opportunity manager 112 creates and assigns a unique identifier for this opportunity that allows the manager 112 to track the opportunity from creation to completion or expiration. These opportunities may be stored in the storage device 108 for tracking and processing by the application 110.

At step 206, the application 110 uses the input to identify a target user community in the transaction-based social network to which the opportunity will be transmitted. The application 110 determines the members by searching profiles in the storage device 108 having data (e.g., user type and/or community) and/or other constraints 308 that meet the criteria specified in the user interface screen 300.

At step 208, the application 110 posts the opportunity over the transaction-based social network to the members of the target user community. By way of illustration, in the user interface screen 300 of FIG. 3, the target user is a sales representative (e.g., in response to the selection of target users in option 316). Thus, as shown in FIG. 4, a user interface screen 400 with sample data as seen by a sales representative determined to be a target user is provided. The user interface screen 400 is provided by the opportunity manager 112 and presented to the target user when the target user selects a tab "Open Opportunities" 401. The user interface screen 400 shows a sample listing of opportunities (including the opportunity posted in step 208 as opportunity 402) having the target user type "Sales Representative," as indicated in a column 404. The posted opportunity 402 includes the unique identifier that was assigned by the opportunity manager 112, which identifier is shown in column 406 of FIG. 4. The target user may review additional details about the posted opportunity 402 or other opportunities in FIG. 4 by selecting (e.g., clicking on) the desired opportunity. As shown in FIG. 5, a user interface screen 500 provides additional details in a window 502. The target user may accept the opportunity by selecting an option "Make Bid" 504 in the window 502. Additionally, the target user may select an option "Request Collaboration" 506, which is described further herein.

Returning to FIG. 2, at step 210, the application 110 monitors network activity for responses from the target user community. A response that accepts the opportunity is referred to as a bid. At step 212, the application 110 determines if a response has been received. If not, the application 110 continues to monitor the network activity at step 210. If, however, a response has been received at step 212, the application 110 updates a table of bids for the opportunity (if more than one bid has been presented) to reflect the acceptance by the target user. The table of bids may be tracked by associating the bids with the unique identifier assigned to the corresponding opportunity.

At step 214, the application 110 provides the user with a view of the bid(s). As shown in FIG. 6, when the user selects a tab "My Posted Opportunities" 602, a user interface screen 600 is presented. The user interface screen 600 includes a window 604 that lists the bids received for the posted opportunity. Details of the bids are presented, such as the name of the target user who submitted the bid, a user ranking, a collaboration bid status, a bidder rate, and bidder comments. The user ranking reflects a value that is assigned to a user placing the bid and is based on feedback received from members of the network who have previously interacted with the user, as will be described further herein. The collaboration bid status indicates whether the user (bidder) has requested collaboration from another user of the target user community, as will be described further herein. Details of this information may be viewed when the poster of the opportunity clicks on the desired bid (e.g., a bid in window 604). The user may either accept or reject a bid by selecting an option "Accept Bid" 606.

At step 216, the application 110 determines if the user has accepted a bid. If not, the bid is marked by the application 110 as rejected at step 218.

If the user has accepted the bid, the bid is marked as accepted. A transaction is implemented according to the nature of the opportunity at step 220. For example, if the opportunity relates to an in-person meeting between a sales representative and a health care provider, the transaction occurs when the sales representative has met with the health care provider in person.

Figure 7:
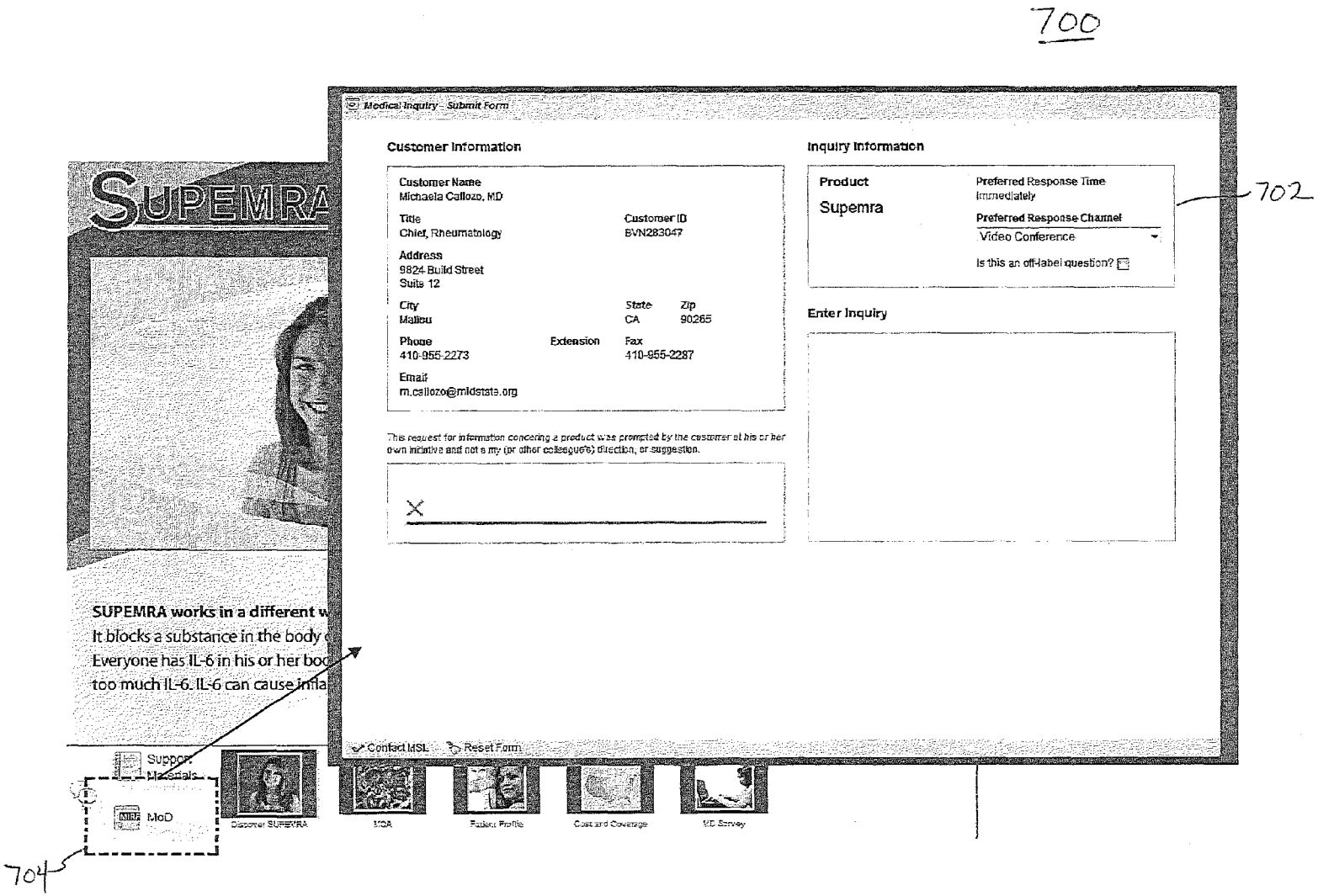

At step 222, the application 110 determines if the opportunity is completed. As indicated above, the process of implementing a transaction for a given opportunity may spawn a new transaction, which is managed by the transaction-based social network and is referred to herein as an implicit transaction. For example, suppose during the course of an in-person meeting between a health care provider (opportunity poster) and a pharmaceutical sales representative concerning a new drug for treatment of rheumatoid arthritis, the health care provider is impressed with the level of knowledge exhibited by the sales representative. The health care provider would like invite the sales representative to conduct a video conference in order to obtain more detailed information. The application 110 is configured to enable the health care provider to expand the opportunity to include a new transaction (i.e., video conference) at step 224. As shown in a window 702 of a user interface screen 700 of FIG. 7, the new transaction may be generated by selecting an option "MoD" (medical information on demand) 704 and the window 702 is presented. The process returns to step 222, and a second transaction is then conducted, i.e., presentation of the video conference. The second transaction represents a spawn from the original opportunity. Thus, two transactions are executed from a single opportunity, and two separate fees may be exchanged therefor. As shown in a user interface screen 800 of FIG. 8, there is one opportunity identifier 802 for two transactions 804 and 806. As indicated above, the content exchanged via the video conference has been evaluated by the content manager 118 and the exchange of information between the two parties is monitored by the remote exchange utility 116 to ensure compliance.

In a further embodiment, the user may decide to create a new opportunity (e.g., if the user is not in immediate need of the desired information, product, or service). In this embodiment, the process returns to step 204, the user enters information about the new opportunity, and a unique identifier is assigned to the opportunity. Alternatively, the user may initiate a new opportunity through a feedback process of the transaction-based social network. This embodiment is described further in FIG. 9. If, however, the opportunity has completed and no additional transactions or opportunities are desired, the opportunity is closed and removed from the network, and the user may view transaction details via the compensation manager 114 at step 226.

The view of the transaction details may be provided by a user interface configured to manage receipts, receivables, payments, and payables associated with the transaction. As shown in FIG. 10, a user interface screen 1000 is presented by selecting an option 1002, and provides information relating to a list of transactions associated with a user. A transaction status of completed, pending, and accepted is associated with each transaction to inform the user of a current status 1004 of the respective transactions. A status of completed indicates the transaction has been successfully executed. A status of pending indicates the bid for an opportunity has not yet been accepted or rejected. A status of accepted indicates the bid supplied by the user has been accepted. In addition, a payment status 1006 of pending and paid is reflected for each transaction, along with an amount 1008 of the transaction. The target user may obtain additional details concerning a particular transaction by selecting (e.g., clicking on) a desired transaction, a sample of which is shown in FIG. 11. A user interface screen 1100 is provided by the compensation manager 114 and illustrates transaction details for a sample transaction in a window 1102.

The compensation manager 114 also allows the users (or posters of opportunities) to view transaction details for their posted opportunities. As shown in FIG. 12, a user interface screen 1200 provides details concerning the status of payments and an amount of money that has been or will be paid out for opportunities and transactions.

Figure 13:
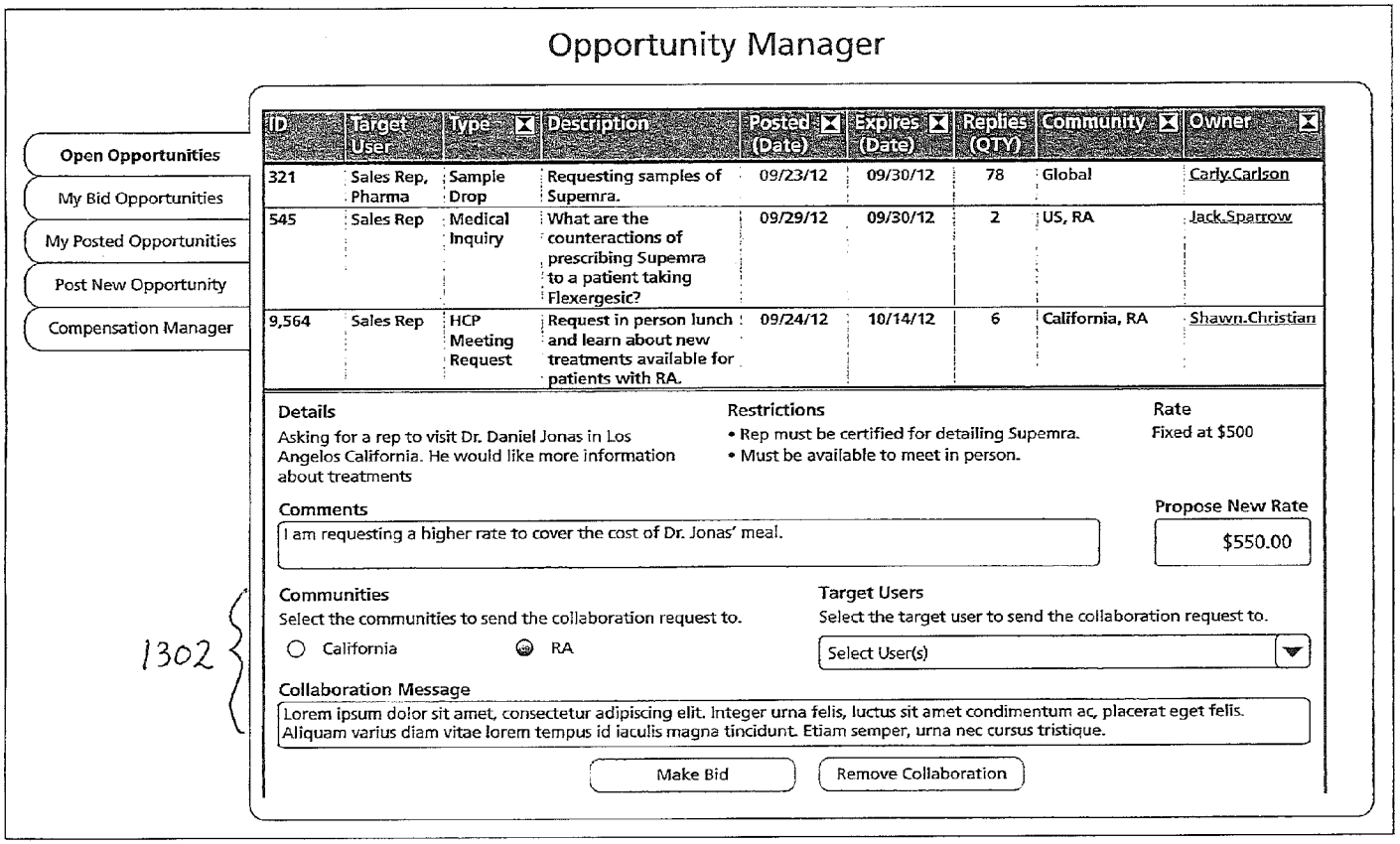

As indicated above, there are many features enabled for users of the transaction-based social network. In an embodiment, a bidder or target user who would like to accept an opportunity may request collaboration from other target users of the user community. A target user may desire to collaborate with other users in the community with respect to the opportunity. For example, suppose the target user is considered an expert on the subject matter of the opportunity but is not familiar with the poster of the opportunity. The target user may be concerned about the prospects of his/her bid being accepted since he/she is an unknown to the poster. Suppose the poster of the opportunity is a health care provider, and the target user knows another user in the community who has a successful working relationship with the health care provider and has established a high level of trust with the health care provider. The target user selects the option "Request Collaboration" 506 from the user interface screen 500 of FIG. 5 (Open Opportunities tab 501), which is provided by the opportunity manager 112. Once selected, a user interface screen 1300 of FIG. 13 is presented to the target user. The user interface screen 1300 includes a section 1302 for selecting a target community to send the collaboration request. When the poster of the opportunity views his/her opportunities (e.g., as shown in FIG. 6), the collaborative bid is indicated in a column 608, the details of which may be viewed by clicking on the corresponding opportunity (e.g., for a bid in window 604). When the details are expanded by the poster of the opportunity, the poster will see the names of both bidders associated with the collaboration bid, which include the bidder who is highly regarded by the poster.

Figure 9:
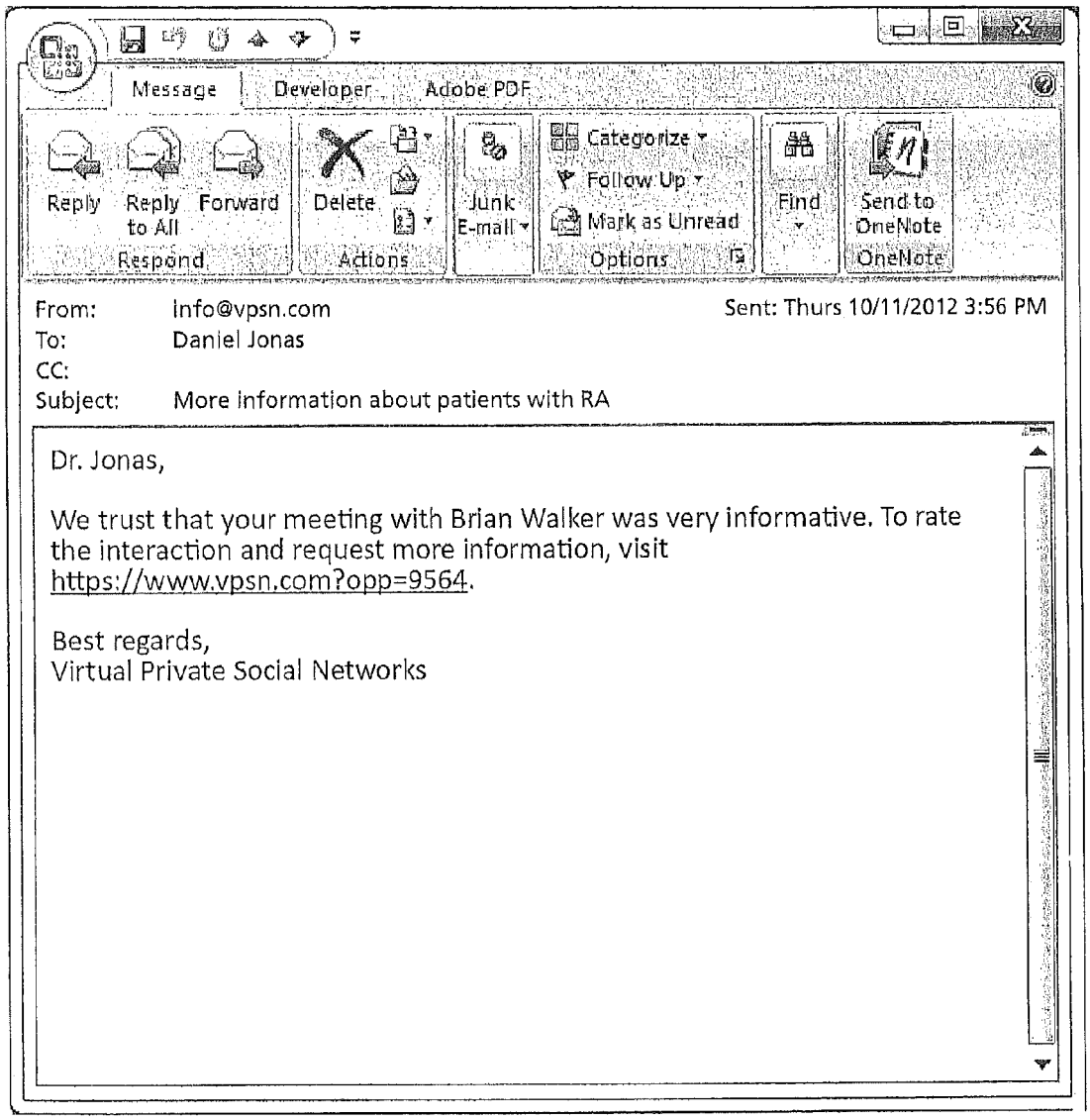

Once an opportunity has been completed, the application 110 may be configured to provide a follow up transmission or message (e.g., an email) prompting the opportunity poster to provide feedback. As shown in FIG. 9, a user interface screen 900 illustrates an email notification to a health care provider requesting that the health care provider rate the interaction that occurred for the opportunity. In addition, this communication may include an opportunity for the addressee to sign up for newsletters, request additional meetings, and other options. In an embodiment, the acceptance by the user to receive newsletters or other information may be processed as a new (and recurring) transaction.

Figure 14:
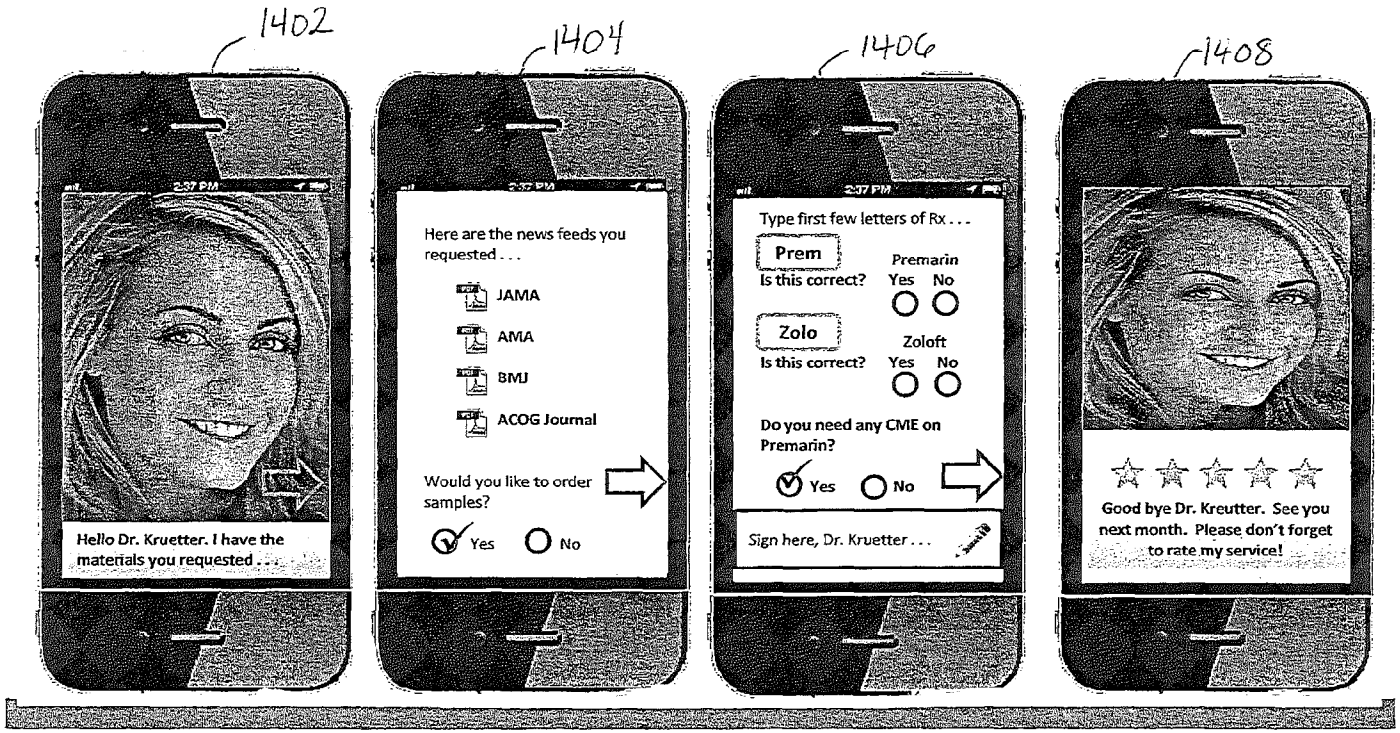

In a further embodiment, a mobile application 111 (shown in FIG. 1) may be provided for implementing at least a portion of the transaction-based social network functions. In an embodiment, a user of the transaction-based social network may access features of the mobile application 111, such as creating and viewing opportunities, viewing transactions, and similar functions. In one embodiment, as shown in FIG. 14, a service agent who is a member of the transaction-based social network enrolls a health care provider in a program configured to provide offerings to the health care provider. The health care provider may choose from a selection of avatars (via a user interface screen) to represent the provider as an agent. A user interface screen 1402 illustrating a selected avatar 1402 is shown in FIG. 14. On a user interface screen 1404, the avatar displays news feeds 1404 selected by the provider, and may also prompt the provider to order samples. If the provider acknowledges this prompt, another user interface screen 1406 is presented which guides the provider in the selection of the samples. Once the user has completed the selection, the avatar may then present a message requesting that the provider rate the service of the avatar via a user interface screen 1408. As shown in the user interface screen 1408, the user may select from 0-5 stars presented thereon. The acceptance by the user to receive news feeds and other related information including the samples may be implemented by the transaction-based social network as separate transactions similar to those described above.

In an embodiment, the service provider enterprise of the host system computer 102 may assess a small fee for each transaction completed over the transaction-based social network.

Technical effects include a transaction-based social network and related functions for qualified members of the life science vertical and related industries. The transaction-based social network provides a business rule-driven content management system along with remote exchange utilities to allow stakeholders to convey information in the form of standard content formats such as Powerpoint, PDF, movies, interactive HTML along with Voice Over IP (VoIP) in a compliant manner.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, HTML, JavaScript, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method, comprising:

qualifying a user, via a computer processor, to join a transaction-based social network for a life science vertical industry based on a minimum set of qualifications;

adding the user, once qualified, to the transaction-based social network;

creating an opportunity from input received by the user, the input specifying criteria with respect to the offer and to a target user community;

identifying, via the computer processor, members of the target user community in the transaction-based social network based on the criteria, the target user community comprising at least a subset of the transaction-based social network;

posting the opportunity over the transaction-based social network to the members of the target user community;

receiving at least one response from the target user community, the at least one response indicative of a bid to accept the opportunity;

providing a view of the bid for the user within a user interface, receiving acceptance of the bid from the user via the user interface, and upon acceptance of the bid, executing a transaction based on a pre-negotiated fee;

validating regulatory compliance of content that is subject to exchange over the transaction-based social network, the content forming at least part of the transaction, the regulatory compliance mandated for the life science vertical industry; and providing the user with access to a compensation manager executable by the computer processor, the compensation manager providing a user interface configured to manage at least one of receipts, receivables, payments, and payables associated with the transaction with respect to the pre-negotiated fee.

2. The method of claim 1, wherein in response to successfully qualifying the user to join the transaction-based social network, the method further comprises:

classifying the user within a user type;

classifying the user within a user community;

creating a profile for the user, the profile including:

identification information for the user;

contact information for the user;

a user type; and a user community; and storing the profile in a storage device.

3. The method of claim 2, wherein the user type specifies professions within the life science vertical industry, and the user type is one of a plurality of selectable user types, the user types including at least one of:

a pharmaceutical company representative;

a pharmaceutical company sales representative;

a freelance pharmaceutical sales representative;

a medical supply sales representative;

a health care provider;
a key opinion leader;
an insurer;
a content agency; and
a medical science liaison.

4. The method of claim 2, further comprising establishing a plurality of user communities that include the user community;

wherein the user communities include at least one of:
global;
country;
region;
state;
specialty; and
tier; and wherein the target user community comprises at least one of the user communities.

5. The method of claim 1, wherein creating the opportunity includes providing the user with access to an opportunity manager executable by the computer processor, the opportunity manager providing a user interface configured to guide the user in creating the opportunity, the creating the opportunity further comprising:

receiving, from the user, via the user interface of the opportunity manager, as the criteria:
an opportunity type;
an opportunity description;
constraints; and
an expiration date of the opportunity;

assigning a unique identifier to the opportunity;

determining the target user community for the opportunity from the criteria;
populating data fields of the user interface of the opportunity manager with the members of the target user community from the determining; and storing the opportunity with the unique identifier in a storage device.

6. The method of claim 5, wherein the constraints include at least one of a geographic location of the opportunity and a topic of the opportunity.

7. The method of claim 1, wherein the opportunity includes a request for at least one of:
an in-person meeting;
a web-based meeting;
an electronic transmission of medically-related information, the medically-related information forming at least part of the content;
delivery of at least one of medical supplies, medical equipment, and medicine samples;
a conference speaker; and
a workshop facilitator.

8. The method of claim 1, further comprising:
assigning a unique identifier to the transaction;
generating a second transaction from the opportunity when a process of executing the transaction results in a request by the user to conduct an activity in addition to the transaction executed for the opportunity;
associating a unique identifier with the second transaction; and
associating a second pre-negotiated fee with the second transaction.

9. The method of claim 8, further comprising:
updating a database to reflect the second transaction and the second pre-negotiated fee; and
providing, via the user interface, a view of updates made with respect to the at least one of receipts, receivables, payments, and payables, the view displaying a status of the transaction and the second transaction within the opportunity with respect to a stage of completion, wherein statuses of transactions are indicated within the user interface as completed, accepted, and pending.

10. The method of claim 1, wherein receiving at least one response from the target user community includes receiving the response from a target user in the target user community, the method further comprising:
providing via the user interface, with respect to the opportunity, a view of bids including the bid from the target user and, updating a status of the view to include the acceptance by the user.

11. The method of claim 1, further comprising receiving a request for a collaborative bid from a target user in the target user community, the request for a collaborative bid including input identifying at least one of a user type associated with a member of a second target user community and a community type, the collaborative bid indicative of a request to jointly execute the opportunity with assistance from another party;
identifying members of the second target user community based on the input from the collaborative bid;
posting the collaborative bid over the transaction-based social network to the second target user community; and
presenting details of the collaborative bid to the user within the view of the bid.

12. The method of claim 1, wherein the minimum set of qualifications include a medical license and a professional certification.

13. A system, comprising:
a computer processor; and
an application executable by the computer processor, the application implementing a method, the method comprising:
qualifying a user to join a transaction-based social network for a life science vertical industry based on a minimum set of qualifications;
adding the user, once qualified, to the transaction-based social network;
creating an opportunity from input received by the user, the input specifying criteria with respect to the offer and to a target user community;
identifying members of the target user community in the transaction-based social network based on the criteria, the target user community comprising at least a subset of the transaction-based social network;
posting the opportunity over the transaction-based social network to the members of the target user community;
receiving at least one response from the target user community, the at least one response indicative of a bid to accept the opportunity;
providing a view of the bid for the user within a user interface, receiving acceptance of the bid from the user via the user interface, and upon acceptance of the bid, executing a transaction based on a pre-negotiated fee;
validating regulatory compliance of content that is subject to exchange over the transaction-based social network, the content forming at least part of the transaction, the regulatory compliance mandated for the life science vertical industry; and
providing the user with access to a compensation manager of the application, the compensation manager providing a user interface configured to manage at least one of receipts, receivables, payments, and payables associated with the transaction with respect to the pre-negotiated fee.

14. The system of claim 13, wherein in response to successfully qualifying the user to join the transaction-based social network, the method further comprises:
classifying the user within a user type;
classifying the user within a user community;
creating a profile for the user, the profile including:
identification information for the user;
contact information for the user;
a user type; and
a user community; and
storing the profile in a storage device.

15. The system of claim 14, wherein the user type specifies professions within the life science vertical industry, and the user type is one of a plurality of selectable user types, the user types including at least one of:
a pharmaceutical company representative;
a pharmaceutical company sales representative;
a freelance pharmaceutical sales representative;
a medical supply sales representative;
a health care provider;
a key opinion leader;
an insurer;
a content agency; and
a medical science liaison.

16. The system of claim 14, wherein the method further comprises establishing a plurality of user communities that include the user community, the user communities including at least one of:
global;
country;
region;
state;
specialty; and
tier; and
wherein the target user community comprises at least one of the user communities.

17. The system of claim 13, wherein creating the opportunity includes providing the user with access to an opportunity manager of the application, the opportunity manager providing a user interface configured to guide the user in creating the opportunity, the creating the opportunity further comprising:
receiving, from the user, via the user interface of the opportunity manager, as the criteria:
an opportunity type;
an opportunity description;
constraints; and
an expiration date of the opportunity;
assigning a unique identifier to the opportunity;
determining the target user community for the opportunity from the criteria;
populating data fields of the user interface of the opportunity manager with the members of the target user community from the determining; and
storing the opportunity with the unique identifier in a storage device.

18. The system of claim 17, wherein the constraints include at least one of a geographic location of the opportunity and a topic of the opportunity.

19. The system of claim 13, wherein the opportunity includes a request for at least one of:
an in-person meeting;
a web-based meeting;
an electronic transmission of medically-related information, the medically-related information forming at least part of the content;
delivery of at least one of medical supplies, medical equipment, and medicine samples;
a conference speaker; and
a workshop facilitator.

20. The system of claim 13, wherein the method further includes:
assigning a unique identifier to the transaction;
generating a second transaction from the opportunity when a process of executing the transaction results in a request by the user to conduct an activity in addition to the transaction executed for the opportunity;
associating a unique identifier with the second transaction; and
associating a second pre-negotiated fee with the second transaction.

21. The system of claim 20, wherein the method further comprises:
updating a database to reflect the second transaction and the second pre-negotiated fee; and
providing, via the user interface, a view of updates made with respect to the at least one of receipts, receivables, payments, and payables, the view displaying a status of the transaction and the second transaction within the opportunity with respect to a stage of completion, wherein statuses of transactions are indicated within the user interface as completed, accepted, and pending.

22. The system of claim 13, wherein receiving at least one response from the target user community includes receiving the response from a target user in the target user community, the method further comprising:
providing, via the user interface, with respect to the opportunity, a view of bids including the bid from the target user and, updating a status of the view to include the acceptance by the user.

23. The system of claim 13, wherein the method further comprises:
receiving a request for a collaborative bid from a target user in the target user community, the request for a collaborative bid including input identifying at least one of a user type associated with a member of a second target user community and a community type, the collaborative bid indicative of a request to jointly execute the opportunity with assistance from another party;
identifying members of the second target user community based on the input from the collaborative bid;
posting the collaborative bid over the transaction-based social network to the second target user community; and
presenting details of the collaborative bid to the user within the view of the bid.

24. The system of claim 13, wherein the minimum set of qualifications include a medical license and a professional certification.

25. A computer program product comprising a non-transitory computer-readable storage medium having instructions embodied thereon, which when executed by a computer processor, cause the computer processor to implement a method, the method comprising:
qualifying a user to join a transaction-based social network for a life science vertical industry based on a minimum set of qualifications;
adding the user, once qualified, to the transaction-based social network;
creating an opportunity from input received by the user, the input specifying criteria with respect to the offer and to a target user community;
identifying members of the target user community in the transaction-based social network based on the criteria, the target user community comprising at least a subset of the transaction-based social network;

posting the opportunity over the transaction-based social network to the members of the target user community;

receiving at least one response from the target user community, the at least one response indicative of a bid to accept the opportunity;

providing a view of the bid for the user within a user interface, receiving acceptance of the bid from the user via the user interface, and upon acceptance of the bid, executing a transaction based on a pre-negotiated fee;

validating regulatory compliance of content that is subject to exchange over the transaction-based social network, the content forming at least part of the transaction, the regulatory compliance mandated for the life science vertical industry; and providing a user interface configured to manage at least one of receipts, receivables, payments, and payables associated with the transaction with respect to the pre-negotiated fee.

26. The computer program product of claim 25, wherein in response to successfully qualifying the user to join the transaction-based social network, the method further comprises:

classifying the user within a user type;

classifying the user within a user community;

creating a profile for the user, the profile including:

identification information for the user;

contact information for the user;

a user type; and a user community; and storing the profile in a storage device.

27. The computer program product of claim 26, wherein the user type specifies professions within the life science vertical industry, and the user type is one of a plurality of selectable user types, the user types including at least one of:

a pharmaceutical company representative;

a pharmaceutical company sales representative;

a freelance pharmaceutical sales representative;

a medical supply sales representative;

a health care provider;

a key opinion leader;

an insurer;

a content agency; and a medical science liaison.

28. The computer program product of claim 26, wherein the method further comprises establishing a plurality of user communities that include the user community, the user communities including at least one of:

global;

country;

region;

state;

specialty; and tier; and wherein the target user community comprises at least one of the user communities.

29. The computer program product of claim 25, wherein creating the opportunity includes providing a user interface configured to guide the user in creating the opportunity, the creating the opportunity further comprising:

receiving, from the user, via the user interface, as the criteria:

an opportunity type;

an opportunity description;

constraints; and an expiration date of the opportunity;

assigning a unique identifier to the opportunity;

determining the target user community for the opportunity from the criteria;

populating data fields of the user interface of the opportunity manager with the members of the target user community from the determining; and storing the opportunity with the unique identifier in a storage device.

30. The computer program product of claim 29, wherein the constraints include at least one of a geographic location of the opportunity and a topic of the opportunity.

* * * * *